United States Patent [19]

Gardiner

[11] 4,084,793

[45] Apr. 18, 1978

[54] WINCH WITH AUTOMATIC CLUTCH ASSEMBLY

[75] Inventor: William P. Gardiner, White Bear Lake, Minn.

[73] Assignee: Byrd Industries, Inc., Memphis, Tenn.

[21] Appl. No.: 688,015

[22] Filed: May 19, 1976

[51] Int. Cl.[2] ..... B66D 1/00

[52] U.S. Cl. ..... 254/187.8; 192/45

[58] Field of Search ..... 254/150 R, 187 R, 187 C, 254/187.8, 186 R, 173 R, 186 HC; 74/812, 325; 192/45, 46, 41 R; 114/210

[56] References Cited

U.S. PATENT DOCUMENTS

| | | | |
|---|---|---|---|
| 503,984 | 8/1893 | Palmer et al. | 192/46 |
| 1,146,339 | 7/1915 | Matthews | 254/150 R |
| 1,629,585 | 5/1927 | Oulton | 192/46 |
| 1,637,818 | 8/1927 | Hawkins | 254/150 R |
| 1,867,409 | 7/1932 | Juergens | 192/46 |
| 2,383,696 | 8/1945 | Thompson | 192/46 |
| 3,145,974 | 8/1964 | Short | 254/150 R |
| 3,802,665 | 4/1974 | Fawcett | 254/150 R |

*Primary Examiner*—Trygve M. Blix
*Assistant Examiner*—Kenneth Noland
*Attorney, Agent, or Firm*—Rogers, Eilers & Howell

[57] ABSTRACT

This invention relates to a winch and clutch assembly having a spool about which a line is to be wound and unwound. An electric motor is mounted within the spool and has a housing and drive shaft operable in the forward and reverse directions. A concentric ring is mounted to and rotates with the spool and a driving gear surrounds the concentric ring, the two having concentric adjacent surfaces. A gear train operatively connects said motor shaft to the concentric driving gear, and a clutch assembly is operatively located between the concentric driving gear and the driven concentric ring, which is selectively engaged and disengaged in response to the direction of rotation of the concentric driving gear so as to produce rotation of said spool in response to operation of said motor in a forward direction when said clutch assembly is engaged.

20 Claims, 11 Drawing Figures

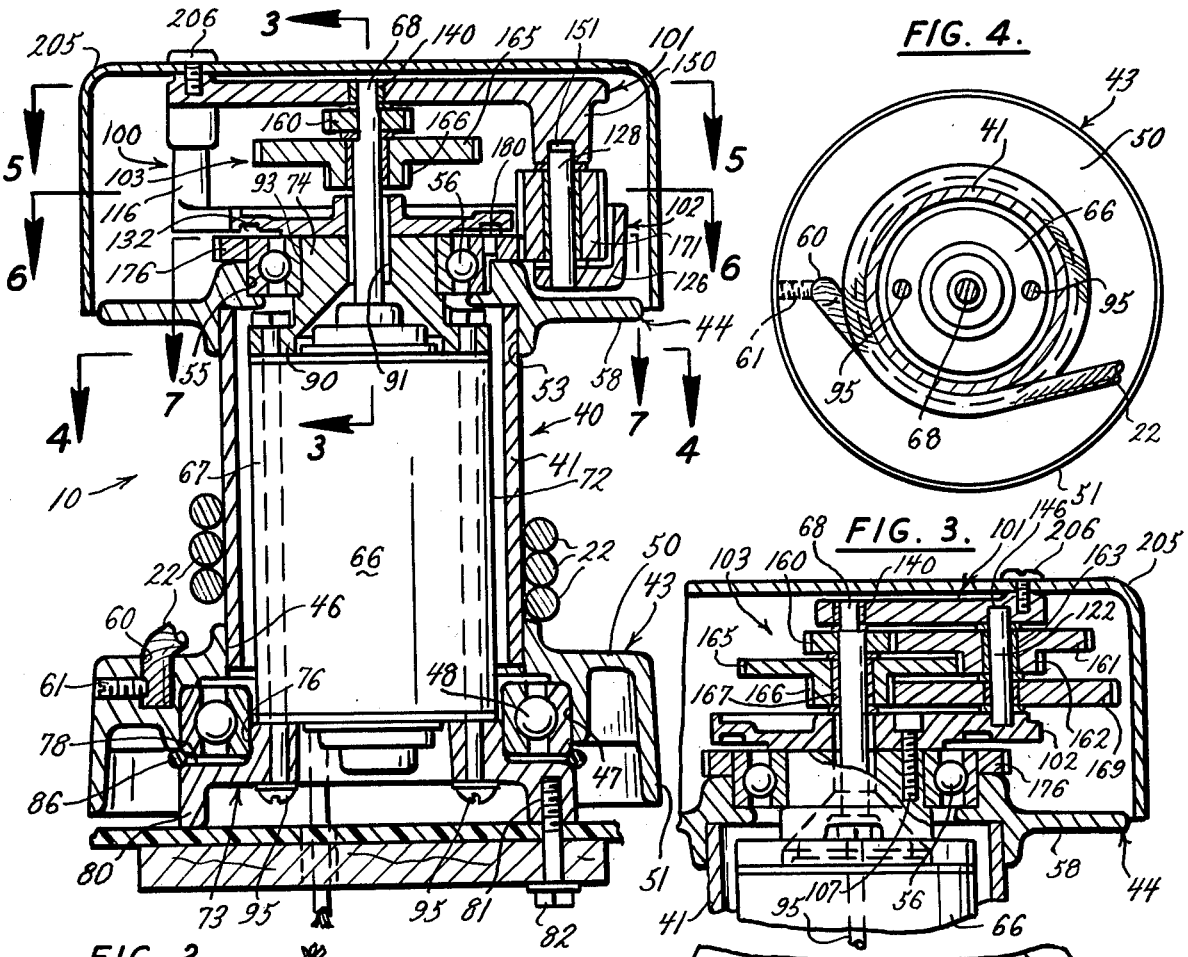
FIG. 4.
FIG. 3.
FIG. 2.
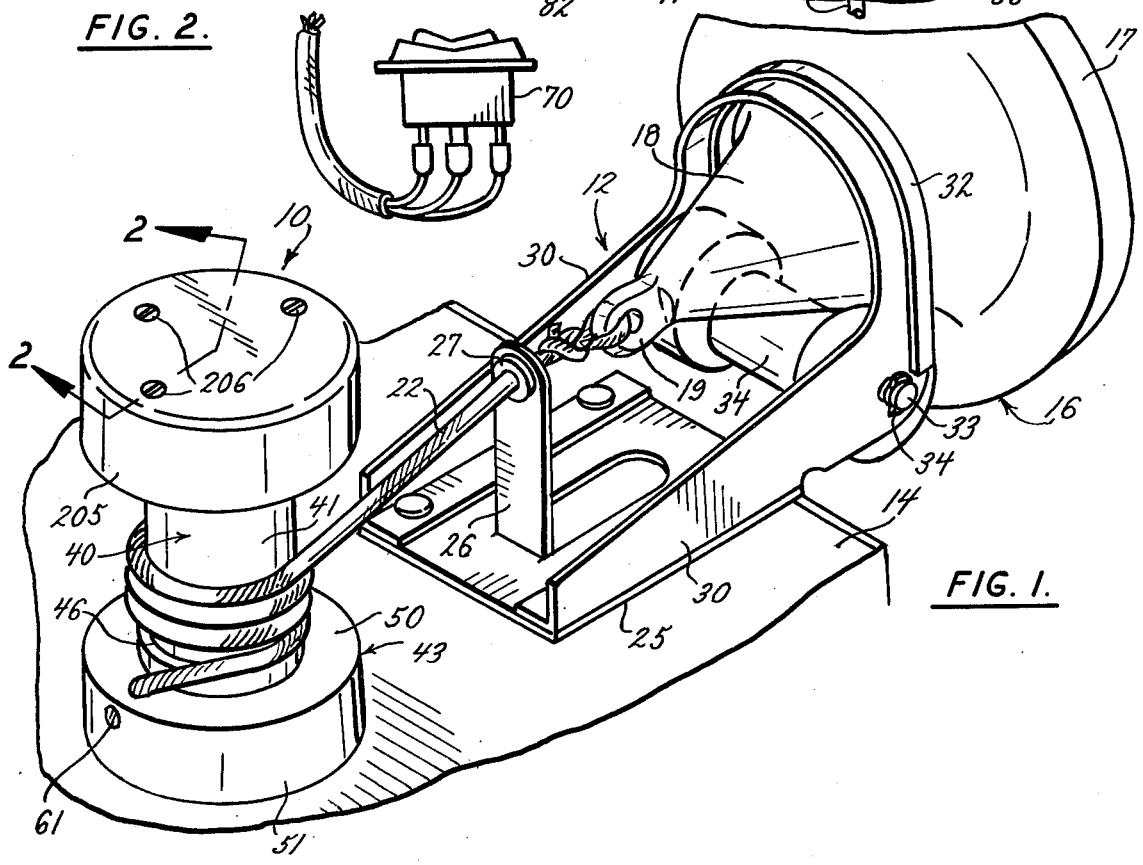
FIG. 1.

WINCH WITH AUTOMATIC CLUTCH ASSEMBLY

BACKGROUND AND SUMMARY OF THE INVENTION

This invention relates to an electric winch and clutch assembly which is exceptionally compact in size and includes an automatically operated clutch that is readily engaged and disengaged without binding.

Electric winches are old in the art, as are those where an electric motor is mounted within the spool portion of the winch. It is also known to include with such winches a clutch mechanism of some type for engaging and releasing the spool. However, it is not believed to be known a winch and clutch assembly as hereinafter described which is of the exceptionally compact design provided by this invention and which includes a clutch assembly automatically engaged and disengaged in response to the direction of rotation of a driving member and which is readily engaged and disengaged without binding.

The winch and clutch assembly of this invention generally comprises a rotatable spool having an electric motor mounted therein for operation in both the forward and reverse directions, the electric motor having a housing and drive shaft. The spool is rotatably mounted on the motor housing and a gear train assembly is mounted at one end of the housing for transmitting power from the motor shaft to a driving gear which is concentric therewith. At that same end of the housing is located a driven member associated with and secured to the spool and which is also concentric with the motor shaft. The driving gear and the driven member have adjacent annular surfaces and there is mounted between the gear and member a clutch assembly which is uniquely designed to be readily engaged and disengaged without binding in response to the direction of rotation of the driving gear.

Hence, it is a primary object of this invention to provide a winch and clutch assembly which is exceptionally compact in design and which includes a clutch which is automatically and readily engaged and disengaged and thus particularly useful for those applications where the spool is to be driven in one direction and released for free rotation in the opposite direction. It is a further primary object of the invention to provide such an assembly wherein there is included an electric drive motor mounted within the spool, and wherein the clutch is automatically engaged and disengaged in response to the direction of rotation of a driving member without the use of any wedging action which could cause binding.

These and other objects of the invention are apparent from the drawing and detailed description to follow.

DESCRIPTION OF THE DRAWINGS

FIG. 1 is a perspective view of the winch and clutch assembly invention shown in combination with an anchor and anchor support as typically mounted on a boat deck or the like;

FIG. 2 is an enlarged view in section taken generally along the line 2—2 of FIG. 1;

FIG. 3 is a view in section taken generally along the line 3—3 of FIG. 2;

FIG. 4 is a view in section taken generally along the line 4—4 of FIG. 2;

DETAILED DESCRIPTION OF A PREFERRED EMBODIMENT

Figure 5:
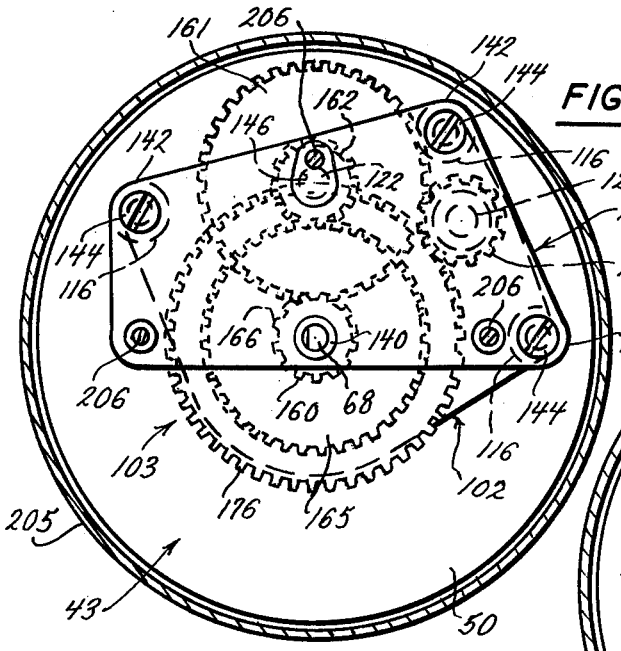
FIG. 5 is a view in section taken generally along the line 5—5 of FIG. 2.

Referring primarily to FIG. 1 of the drawing there is shown a winch and clutch assembly 10 of this invention in combination with an anchor mount assembly 12 both mounted on a deck 14 of a boat or the like for hoisting and lowering an anchor 16. This arrangement is shown by way of example as depicting the primary purpose for which the winch and clutch assembly of this invention was designed. However, it is to be understood that the winch and clutch assembly 10 is useful for operating many other devices besides anchors. Its use with an anchor illustrates the objectives of providing a winch and clutch assembly that is small and compact in design and yet sufficiently powerful to operate an anchor or the like, and which includes a clutch arrangement that can be automatically engaged such as for hoisting the anchor, and automatically disengages upon reversal of the spool drive to allow free fall of the anchor. The winch 10 is particularly useful wherever such requirements exist.

The anchor 16 is shown to be of the mushroom type having a disk portion 17 and a shank portion 18 terminating in an eyelet 19, the anchor 16 being attached to the winch 10 by means of a rope or line 22 connected at one end to the eyelet 19 and the other end to the winch in a manner to be described.

The anchor mount 12 includes a base plate 25 having an upwardly extending member 26 defining a line guide with a bushing 27 through which the line 22 extends. The anchor mount 12 has side rails 30 which terminate outwardly of the line guide 26 in a hood 32. A roller 34 is mounted between the rails 30 beneath the hood 32 by means of a pin 33 and retainer ring 34.

From FIG. 1 it can be seen that with the anchor in the fully raised position, the shank 18 extends through the hood 32 and rests on the roller 34, the roller 34 thus supporting a portion of the weight of the anchor and aiding in supporting the anchor generally horizontally when in the fully raised position.

With reference to the remaining figures of the drawing, the winch and clutch assembly of this invention will now be described.

The winch 10 includes a spool 40 having a cylindrical portion 41 about which the line 22 is wound, and end flanges 43 and 44. The flange 43 has an inwardly facing annular surface 46 which securely receives one end of the cylinder 41 and another inwardly facing annular surface 47 in which is securely received the outer race of a bearing 48. The flange 43 further includes a radial shoulder 50 terminating outwardly in a skirt portion 51.

The flange 44 has an inwardly facing annular surface 53 for securely receiving the other end of the cylinder 41, and another inwardly facing annular surface 55 for receiving the outer race of a bearing 56, a portion of which extends above the flange 44. The flange 44 also includes an outwardly extending radial shoulder 58 which together with the radial shoulder 50 acts to retain the line 22 on the spool.

For securing an end of the line 22 to the winch, the flange 50 has a hole 60 for receiving one end of the line 22, which hole communicates with a threaded aperture and set screw 61 for securing the end of the line to the flange.

A motor 66 is mounted within the spool 40 and includes a housing 67 and a drive shaft 68. The electric motor 66 is preferably of a type operable in both forward and reverse directions by means of a suitable direct current power source (not shown), and a suitable three-position switch 70, a first position energizing the motor to operate in a forward direction, a second position energizing the motor to operate in a reverse direction, and a third position to deenergize the motor. Such electric motors and switches are commercially available to operate, for example, from a 12 volt D.C. battery source of a type customarily used with land vehicles and boats.

The motor housing 67 includes a cylindrical portion 72, a base 73 at one end, and a cap 74 at the other end. The base 73 has an outwardly facing annular surface 76 for securely receiving the inner race of the bearing 48, a radially outwardly extending shoulder 78 and an annular support flange 80 which has threaded holes 81 therein for receiving bolts 82 for mounting the winch 10 to a deck of a boat or the like. The bearing 48 is spaced above the shoulder 78, and the space between the shoulder 78 and bearing 48 is sealed by means of an O-ring 86.

The cap 74 includes an outwardly extending radial shoulder 90, an opening 91 through which the shaft 68 on the electric motor 66 extends, and an outwardly facing annular surface 93 for securely receiving the inner race of the bearing 56. The cylindrical portion 72 of the motor housing 67 is secured between the base 73 and cap 74 by means of through bolt and nut assemblies 95 extending through appropriate apertures in the base 73, cap 74, and within the cylindrical portion 72 itself.

Thus, it can be seen that the spool 40 is rotatably mounted about the motor housing 67 by means of the bearings 48 and 56.

A frame support 100 having a top frame member 101 and a bottom frame member 102 is attached to the cap 74 for supporting a gear train assembly 103.

Figure 6:
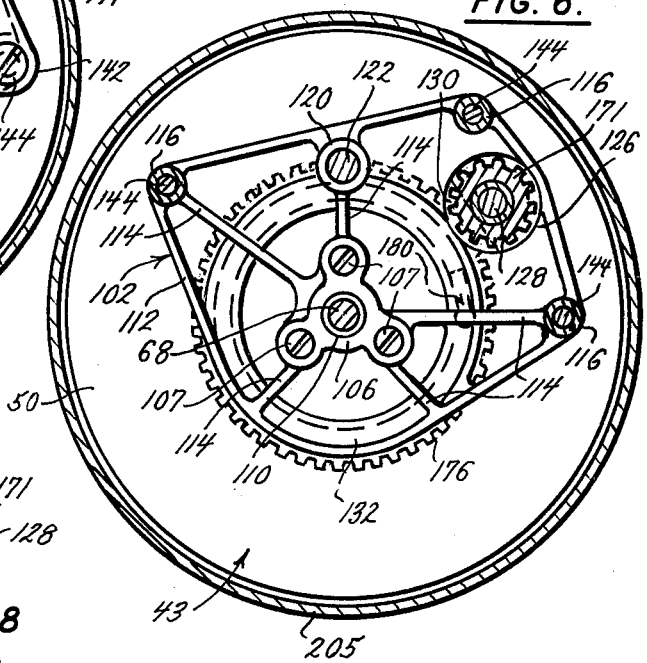
FIG. 6 is a view in section taken generally along the line 6—6 of FIG. 2.
Figure 7:
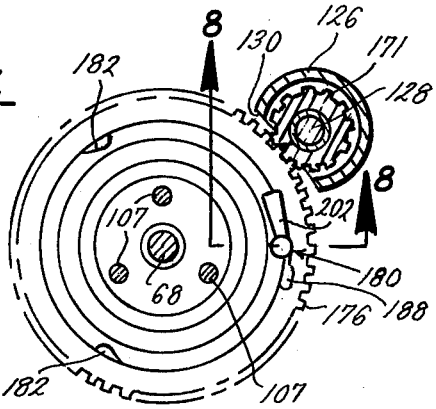
FIG. 7 is a view in section taken generally along the line 7—7 of FIG. 2.
Figure 8:
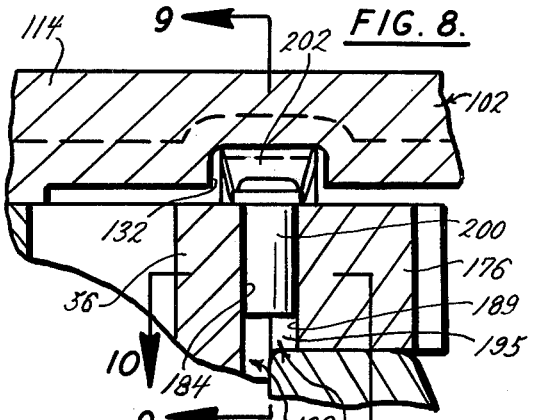
FIG. 8 is an enlarged view in section taken generally along the line 8—8 of FIG. 7.

As best shown in FIGS. 2, 3, and 6, the lower frame support 102 is a ribbed plate having a central hub 106 secured to the cap 74 by means of screws 107, the hub 106 having a hole 110 through its center and through which the shaft 68 of the motor extends. Surrounding the hub 106 is a rib 112 shaped generally as shown in FIG. 6 with ribs 114 extending between the hub and rib 112. At the rib 112 are located upwardly extending corner posts 116 for use in mounting the upper frame member 101 as will be described. Near, but somewhat inwardly from, the rib 112 is a boss 120 having an aperture therein for receiving the lower end of a gear shaft 122.

Spaced circumferentially from the boss 120 relative to the shaft 68 of the motor is a pocket or well 126 having an aperture in the bottom thereof for receiving the lower end of a gear shaft 128. The inner side of the well 126 is cut away at 130 for purposes to be described. Also, the underside of the bottom frame member 102 has an annular channel or groove 132 which is concentric with the motor shaft 68.

The upper frame member 101 is shaped generally as shown in FIGS. 2, 3, and 5 having an aperture near one edge thereof for receiving a bearing 140 and the end of the motor shaft 68. Three of the corners 142 of the frame member 101 have apertures in axial alignment with the posts 116 of the frame member 102. Screws 104 extend through the apertures of the member 101 and into threaded holes in the posts 116 to secure the frame member 101 to the frame member 102, the posts 116 providing space between the frame members for mounting gears as will be described.

Near the edge of the frame member 101, opposite the shaft 68, is an aperture 146 for receiving the upper end of the gear shaft 122, the aperture 146 being in axial alignment with the boss 120 of the frame member 102. The frame member 101 also has a boss 150 having an aperture 151 therein which is in axial alignment with the aperture at the bottom of the well 126 and which receives the upper end of the gear shaft 128.

The gear train 103 includes a spur gear 160 secured to the motor shaft 68 just beneath the frame member 101, which gear drives spur gears 161 and 162 rotatably mounted on the shaft 122 by means of a suitable bearing 163. The gear 162 drives spur gears 165 and 166 rotatably mounted on the motor shaft 68 by means of a suitable bearing 167, the gear 166 driving a gear 169 mounted on the shaft 122.

A gear 171 is mounted on the shaft 128 and has a portion projecting above the lower frame member 102 and has its teeth extending into the cut-away portion 130 at the inner side of the well 126. The gear 169 drives the gear 171 by engaging its upwardly extending portion.

A spur gear 176 is mounted about the portion of the and is concentric with the motor shaft bearing 56 that extends above the spool flange 44, and is concentric with the motor shaft 68. The gear 176 has teeth on its outer surface which engage the gear 171 at the cut-away portion 130 of the well 126. The gear 176 has an inner annular surface which is contiguous with that portion of the outer surface of the bearing 56 which projects above the spool flange 44. A clutch assembly 180 engages and disengages the driving member or gear 176 with the driven member or outer race of the bearing 56 as will now be described.

The clutch assembly 180 is best shown in FIGS. 7 through 11. Thus, the clutch assembly 180 includes recesses 182 in the outer surface of the outer bearing race of the bearing 56. The recesses 182 each have a leading rounded portion 183 and a trailing tapered portion 184 which tapers from the rounded portion outwardly to the outer surface of the bearing race. The use of the terms "leading" and "trailing" are with reference to the direction of rotation shown by the arrows in FIG. 10. Three of the recesses 182 are shown equally spaced about the outer surface of the bearing 56 although a greater or lesser number of such recesses could be used.

The clutch assembly 180 also includes a recess 188 formed in the inner surface of the gear 176. The recess 188 has a relatively shallow portion 189 and a deeper portion 190. The leading end of the portion 190 terminates in a rounded portion 192 and its trailing end terminates in a rounded portion 193 which also leads into the leading end of the shallower portion 189. The trailing end of the shallower portion 189 terminates in a rounded portion 195.

Figure 9:
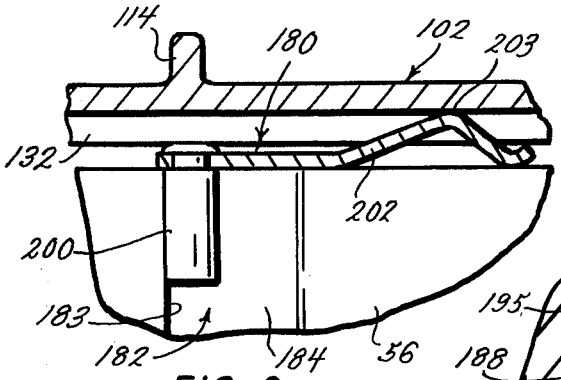
FIG. 9 is a view in section taken generally along the line 9—9 of FIG. 8.

Also as part of the clutch assembly 180 there is included a pin 200 which is caused to selectively seat within the recesses 182 and 188 for engagement and disengagement. A drag member or leaf spring 202, as best shown in FIG. 9, trails the forward rotation of the driving gear 176 and extends within the annular channel 132 in the lower frame member 102 to engage the upper surface of the channel at 203.

The radii of curvature of the rounded portions 183, 192, 193, and 195 are approximately that of the pin 200. The depth of the rounded portions 183, 193, and 195 is approximately equal to the radius of the pin 200, and the depth of the rounded portion 192 is approximately equal to the diameter of the pin 200. Additionally, the relatively shallow portion 189 and the deeper portion 190 of the recess 188 are preferably greater in length than the diameter of the pin 195, and the depth of each of these portions is constant throughout its length.

Figure 11:
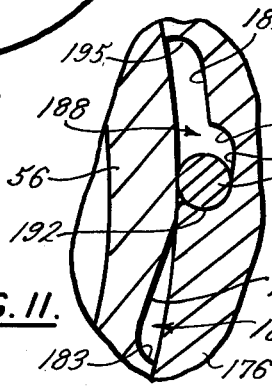
FIG. 11 is a view similar to that of FIG. 10 but showing the clutch assembly in the disengaged position.
Figure 10:
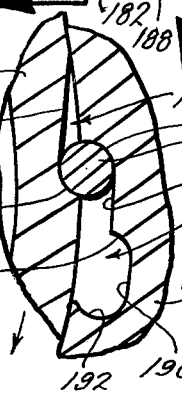
FIG. 10 is a view in section taken generally along the line 10—10 of FIG. 8 and showing the clutch assembly means of this invention in the engaged position.

It will be noted that with the clutch engaged, as shown in FIG. 10, the pin 200 is locked between the rounded surfaces 183 and 195 which engage opposite sides of the pin, while with the clutch disengaged as shown in FIG. 11, the pin 200 is engaged by the rounded portion 192 so as to be totally within the deeper portion of the recess 188 and out of the recess 182. It will further be noted that at no time does the engagement of the clutch assembly depend on any wedging action between the pin 200 and the walls of the recesses 182 and 188. It is a primary feature of this invention that the clutch assembly 180 operates without any wedging action so as to be readily engaged and disengaged for power drive or free rotation of the spool.

A cover 205 fits over the gear train 103 and is secured to the upper frame member 101 by means of screws 206 which engage threaded holes in the member 101.

Operation

To operate the winch and clutch assembly 10, assume that the anchor 16 is to be hoisted to the position shown in FIG. 1. The switch 70 is pressed to a position to actuate the electric motor 66 in a "forward" direction which is defined herein as the direction for hoisting the anchor. Actuation of the motor 66 causes the motor shaft 68 to rotate at a relatively high speed and thereby drive the spur gear 176 at a comparatively low speed through the gear train assembly 103 as heretofore described. Assuming that the clutch assembly 180 had not theretofore been engaged, and was thus in the position shown in FIG. 11, forward rotation of the driving gear 176, as shown by the arrows in FIG. 10, will cause the pin 200, which has some drag imposed on it by frictional engagement of the leaf spring 22 in the groove 132, to be urged to the trailing end of the deeper portion 190 of the recess 188. As the recess 188 comes upon a recess 182 in the driven member 56, which at this instant of time is stationary, the pin will begin to slide down the tapered portion 184 of the recess 182. This is caused by a pivotal action of the pin and drag member whereby the drag member 202 is urged to pivot about 203 in a clockwise direction as received in FIG. 7 so that the pin 200 is urged against the tapered portion 182. When the pin 200 gets near the rounded portion 183, it will move out of the deeper portion 190 and into the shallower portion 189 of the recess 188 to engage the rounded portion 195. When this occurs, the pin 200 is locked between the rounded portions 183 and 195 thus engaging the outer race of the bearing 56 causing said outer race to rotate with the gear 176. It will be appreciated that it takes only a fraction of a second from the time that the motor is actuated in the forward direction until the clutch 180 engages as shown in FIG. 10. With the clutch 180 engaged, the outer race of the bearing 56 and thus the entire spool 40 rotates in a direction to wind the line 22 about the spool and hoist the anchor to the position shown in FIG. 1.

Lowering the anchor is accomplished by simply disengaging the clutch 180 and allowing the anchor to free fail. To disengage the clutch, the switch 70 is depressed to a position energizing the electric motor 66 to operate in the reverse direction thus causing the driving gear 176 to rotate in a direction opposite the arrows of FIG. 10. Since some of the weight of the anchor 16 is supported by the roller 34 of the anchor mount 12, the load on the spool 41 is insufficient to prevent disengagement of the clutch assembly 180 upon reverse rotation of the driving gear 176. Therefore, reversal of the driving gear 176 causes that gear to rotate in the reverse direction relative to the outer race of the bearing 56. When this occurs, the pin 200 is urged to pivot about 203 in the counterclockwise direction as viewed in FIG. 7 and begins to move out of the rounded portion 195 and along the relatively shallow portion 189 and into the deeper portion 190 of the recess 188. As the pin 195 reaches the rounded portion 193, it is urged into the deeper portion 190 as it moves along the tapered portion 184 of the recess 182 until it ultimately lodges in the rounded portion 192. When this occurs, the pin 200 is totally out of the recess 182 and completely in the recess 188 thereby allowing the outer race of the bearing 56, and thus the spool 41, to rotate freely in the reverse direction and allow the anchor to free fall. With the clutch disengaged, the spool will rotate freely in either direction.

Once the anchor has dropped, the winch 10 can be engaged by momentarily depressing the switch 70 to operate the winch in the forward direction so as to once again engage the clutch as shown in FIG. 10. The clutch will then remain engaged until the winch is again reversed.

The construction of the winch and clutch assembly of this invention provides a very compact design with the motor mounted within the spool and the gear train drive at one end. The clutch assembly further adds to the compactness of the design in providing an automatically engaging and disengaging clutch that requires virtually no additional space. It is additionally significant that the clutch assembly 180 operates in respose to the direction of rotation of the driving gear 176 and without any "wedging" action that could cause binding of the clutch and thereby prevent ready disengagement for releasing the anchor or other load. The pin 200 is "clamped" between the rounded surfaces 183 and 195 when the clutch is engaged and there is no wedging action at all. With the clamping action described, the clutch is readily disengaged by simple reversal of the winch, without any fear of binding.

Thus, there has been described an improved winch and clutch assembly offering significant advantages and fulfilling the objects heretofore recited.

Various changes and modifications may be made in this invention, as will be readily apparent to those skilled in the art. Such changes and modifications are within the scope and teaching of this invention as defined by the claims appended hereto.

What is claimed is:

1. A winch and clutch assembly comprising a spool about which a line is to be wound and unwound, a motor having a housing and a drive shaft, a frame associated with the housing, an annular driven member associated with said spool such that rotation of said driven member imparts rotation to said spool, drive means connecting said motor shaft to said annular driven member to drive said annular driven member, said drive means including an annular driving member, said driven member and said driving member having concentric, adjacent surfaces, at least one first recess in said concentric surface of said driving member and at least one second recess in said concentric surface of said driven member, an annular bearing, a pivot member associated with said bearing the pivot member movably attached to the frame during operation and the entire pivot member operably movable to urge said bearing into said first and second recesses to drivingly engage said driving member to said driven member in response to the relative movement between said driving member and said driven member in a first direction, and to urge said bearing out of such engagement in response to relative movement between said driven member and said driving member in a direction opposite the first direction.

2. The structure of claim 1 wherein said bearing is a pin and wherein said pivot member comprises a leaf spring connected to said pin.

3. The structure of claim 1 wherein said frame has an annular groove and wherein said leaf spring extends within said groove.

4. The structure of claim 1 further comprising means for mounting said motor within said spool.

5. A winch and clutch assembly comprising a spool about which a line is to be wound and unwound, a motor having a housing and a drive shaft, an annular driven member associated with said spool so that rotation of said driven member imparts rotation to said spool, drive means connecting said motor shaft to said annular driven member to drive said annular driven member, said means for driving including an annular driving member, said driven member and said driving member having concentric, adjacent surfaces, an annular bearing, one of said adjacent surfaces having a first recess, said first recess having a surface having a rounded portion of approximately the same radius of curvature as said bearing, the other said adjacent surface having a second recess, said second recess having a shallow surface portion with a rounded portion of approximately the same radius of curvature as said bearing and having a depth such that the depth of the rounded portion of the first recess and the rounded portion of said second recess together are approximately equal to the diameter of the bearing, the rounded portion of the first recess facing opposite to the shallow rounded portion of the second recess, said second recess having a deep portion of a depth at least as great as the diameter of said bearing and a length at least as great as the diameter of said bearing to receive said bearing, means for urging said bearing in engagement between the rounded portion of said first recess and the rounded portion of the shallow portion of said second recess upon rotation of the driving member relative to the driven member in a first direction, and means for engaging said bearing in the deep portion of said second recess upon rotation of the driving member relative to the driven member in a direction opposite the first direction, the second recess having a surface with means for engaging the bearing to hold said bearing in said deep portion and out of wedging engagement with said one adjacent surface when said relative movement is in the first direction until said shallow portion is positioned in alignment with the first recess to allow the bearing to extend into the first recess and into the shallow portion.

6. The structure of claim 5 wherein said first recess has a tapered surface extending inwardly from said one adjacent surface and into the rounded portion of said first recess.

7. The structure of claim 5 wherein said means to hold said bearing in said deep portion further comprises an engaging surface portion of the deep portion facing the same general direction as the rounded portion of the shallow portion.

8. The structure of claim 7 wherein the engaging surface to hold said bearing in said deep portion is rounded to the same radius of curvature as said bearing.

9. The structure of claim 5 wherein the said rounded portion of said first recess and said shallow rounded portion of said second recess each have a depth approximately equal to the radius of said bearing.

10. The structure of claim 9 wherein said deep portion of the second recess has a rounded portion of approximately the same radius of curvature as said bearing and facing opposite the rounded portion of the shallow portion.

11. The structure of claim 5 further comprising means for mounting said motor within said spool.

12. The structure of claim 5 wherein said shallow portion and deep portion of the second recess are each longer than the diameter of said bearing.

13. The structure of claim 12 wherein said shallow and deep portions are each of generally constant depth.

14. The structure of claim 5 wherein said driven member is inside said driving member.

15. The structure of claim 14 wherein said driving member has an external gear surface driven by said motor shaft connecting means.

16. A winch and clutch assembly comprising a spool about which a line is to be wound and unwound, a motor having a housing and a drive shaft, an annular driven member associated with said spool so that rotation of said driven member imparts rotation to said spool, drive means connecting said motor shaft to said annular driven member to drive said annular driven member, said drive means including an annular driving member, said driven member and said driving member having concentric, adjacent surfaces, an annular bearing, one of said adjacent surfaces having a first recess, said first recess having a surface having a rounded portion of approximately the same radius of curvature as said bearing, the other said adjacent surface having a second recess, said second recess having a shallow surface portion with a rounded portion of approximately the same radius of curvature as said bearing and having a depth such that the depth of the rounded portion of the first recess and the rounded portion of said second recess together are approximately equal to the diameter of the bearing, the rounded portion of the first recess facing opposite to the shallow rounded portion of the second recess, said second recess having a deep portion of a depth at least as great as the diameter of said bearing and a length at least as great as the diameter of said bearing to receive said bearing, an urging member associated with said bearing, and means including said urging member operable to urge said bearing into engagement between the rounded portion of said first recess and the rounded portion of the shallow portion of said second recess upon rotation of the driving member relative to the driven member in a first direction, and to urge said bearing in the deep portion of said second recess upon rotation of the driving member relative to the driven member in a direction opposite the first direction, the second recess having a surface with means for engaging the bearing to hold said bearing in said deep portion and out of wedging engagement with said one adjacent surface when said relative movement is in the first direction until said shallow portion is positioned in alignment with the first recess to allow the bearing to extend into the first recess and into the shallow portion.

17. The structure of claim 16 wherein the urging member of said urging means comprises a pivot member engaged to said bearing and means for pivoting said pivot member to move said bearing into and out of said driving engagement.

18. The structure of claim 16 wherein said first recess has a tapered surface extending inwardly from said one adjacent surface and into the rounded portion of said first recess, and wherein said means to hold said bearing in said deep portion further comprises an engaging surface portion of the deep portion facing the same general direction as the rounded portion of the shallow portion, and rounded to the same radius of curvature as said bearing.

19. The structure of claim 18 wherein said rounded portion of said first recess and said shallow rounded portion of said second recess each have a depth approximately equal to the radius of said bearing, and wherein said deep portion of the second recess has a rounded portion of approximately the same radius of curvature as said bearing facing opposite the rounded portion of the shallow portion.

20. A winch and clutch assembly comprising a spool about which a line is to be wound and unwound, a motor having a drive shaft and a housing having an annular groove, said motor being mounted within said spool, an annular driven member associated with said spool so that rotation of said driven member imparts rotation to said spool, drive means connecting said motor shaft to said annular driven member to drive said annular driven member, said means for driving including an annular driving member, said driven member and said driving member having concentric, adjacent surfaces, an annular bearing, one of said adjacent surfaces having a first recess having a surface with a rounded portion of approximately the same radius of curvature as said bearing and a tapered portion extending inwardly from said one adjacent surface into the rounded portion of said first recess, the other said adjacent surface having a second recess, said second recess having a shallow surface portion with a rounded portion facing opposite the rounded portion of the first recess and of approximately the same radius of curvature as said bearing, said shallow rounded portion of said second recess and said rounded portion of said first recess each having a depth approximately equal to the radius of said bearing, said shallow portion being longer than the diameter of said bearing and having a generally constant depth, said second recess having a deep portion of a generally constant depth at least as great as the diameter of said bearing and a length at least as great as the diameter of said bearing to receive said bearing, said deep portion having a rounded portion of approximately the same radius of curvature as said bearing and facing opposite the rounded portion of the shallow portion, a pivot leaf spring connected to said bearing and extending within the annular groove of the housing operable to urge said bearing into engagement between the rounded portion of said first recess and the rounded portion of the shallow portion of said second recess upon rotation of the driving member relative to the driven member in a first direction and to urge said bearing into the deep portion of said second recess upon rotation of the driving member relative to the driven member in a direction opposite the first direction, the second recess having an engaging surface portion of the deep portion rounded to approximately the same radius of curvature as said bearing and facing the same general direction as the rounded portion of the shallow portion for engaging the bearing to hold said bearing in said deep portion and out of wedging engagement with said one adjacent surface when said relative movement is in the first direction until said shallow portion is positioned in alignment with the first recess to allow the bearing to extend into the first recess and into the shallow portion.

* * * * *